US006968637B1

(12) United States Patent
Johnson

(10) Patent No.: US 6,968,637 B1
(45) Date of Patent: Nov. 29, 2005

(54) SOLE-MOUNTED FOOTWEAR STABILITY SYSTEM

(75) Inventor: Jeffrey L. Johnson, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 150 days.

(21) Appl. No.: 10/093,294

(22) Filed: Mar. 6, 2002

(51) Int. Cl.[7] ..... A43B 7/14; A43B 7/22; A43B 23/00; A61F 5/14

(52) U.S. Cl. ..... 36/88; 36/91; 36/108; 36/30 R; 36/151; 36/182

(58) Field of Search ..... 36/88, 91, 92, 36/107, 108, 27, 28, 30 R, 143, 144, 151, 36/148, 179, 182

(56) References Cited

U.S. PATENT DOCUMENTS

| | | | | |
|---|---|---|---|---|
| 730,366 A | | 6/1903 | Gunthorp | |
| 881,974 A | * | 3/1908 | Toporczer | 36/179 |
| 892,152 A | | 6/1908 | Harman | |
| 1,470,618 A | * | 10/1923 | Craine | 36/179 |
| 1,548,469 A | * | 8/1925 | Johnson | 36/182 |
| 1,848,518 A | * | 3/1932 | Doran et al. | 36/182 |
| 2,569,721 A | | 10/1951 | Juers | |
| 3,613,274 A | | 10/1971 | Wiley | |
| 3,999,558 A | * | 12/1976 | Barnwell et al. | 36/145 |
| 4,162,583 A | | 7/1979 | Darrin | |
| 4,316,334 A | | 2/1982 | Hunt | |
| 4,399,621 A | | 8/1983 | Dassler | |
| 4,441,499 A | * | 4/1984 | Comparetto et al. | 36/154 |
| 4,454,662 A | | 6/1984 | Stubblefield | |
| 4,507,879 A | | 4/1985 | Dassler | |
| 4,542,598 A | | 9/1985 | Misevich et al. | |
| 4,562,651 A | | 1/1986 | Frederick et al. | |
| 4,667,425 A | | 5/1987 | Effler et al. | |
| 4,756,098 A | | 7/1988 | Boggia | |
| 4,787,156 A | | 11/1988 | Bade | |
| 4,817,304 A | | 4/1989 | Parker et al. | |
| 4,922,630 A | | 5/1990 | Robinson | |
| 4,922,631 A | | 5/1990 | Anderie | |
| 5,052,130 A | | 10/1991 | Barry et al. | |
| 5,185,943 A | * | 2/1993 | Tong et al. | 36/28 |
| 5,245,766 A | | 9/1993 | Warren | |
| 5,297,349 A | | 3/1994 | Kilgore | |
| 5,311,680 A | | 5/1994 | Comparetto | |
| 5,319,866 A | | 6/1994 | Foley et al. | |
| 5,343,639 A | | 9/1994 | Kilgore et al. | |
| 5,353,523 A | | 10/1994 | Kilgore et al. | |
| 5,400,529 A | | 3/1995 | Bell et al. | |
| 5,452,526 A | | 9/1995 | Collins | |
| 5,465,509 A | | 11/1995 | Fuerst et al. | |
| 5,467,537 A | | 11/1995 | Aveni et al. | |
| 5,647,145 A | | 7/1997 | Russell et al. | |

(Continued)

FOREIGN PATENT DOCUMENTS

| | | | |
|---|---|---|---|
| DE | 29712705 | U1 | 11/1997 |
| EP | 1002473 | A1 | 5/2000 |

*Primary Examiner*—Anthony Stashick
(74) *Attorney, Agent, or Firm*—Banner & Witcoff, Ltd.

(57) ABSTRACT

The present invention is an article of footwear having a stabilizing element incorporated into a sole structure. The stabilizing element is located primarily in the midfoot region of the footwear but extends into both the forefoot and heel regions. In one embodiment, the stabilizing element includes five stabilizing members that extend from a connecting member. The function of the stabilizing members is to provide support along the longitudinal length of the foot so as to limit non-axial, vertical flexion in the midfoot and heel regions; permit the forefoot to axially flex in relation to the heel; and permit forefoot flexion.

44 Claims, 3 Drawing Sheets

U.S. PATENT DOCUMENTS

| | | | | |
|---|---|---|---|---|
| 5,737,854 | A | 4/1998 | Sussmann | |
| 5,832,634 | A | 11/1998 | Wong | |
| 5,845,420 | A | 12/1998 | Buccianti et al. | |
| 5,884,420 | A | 3/1999 | Donnadieu | |
| 5,896,683 | A | 4/1999 | Foxen et al. | |
| 6,000,148 | A | 12/1999 | Cretinon | |
| 6,006,451 | A | 12/1999 | Morris et al. | |
| 6,009,641 | A | 1/2000 | Ryan | |
| 6,502,330 | B1 * | 1/2003 | David et al. | 36/88 |
| 2001/0001907 | A1 | 5/2001 | Luthi et al. | |

* cited by examiner

SOLE-MOUNTED FOOTWEAR STABILITY SYSTEM

BACKGROUND OF THE INVENTION

1. Field of the Invention

The present invention relates to athletic footwear. The invention concerns, more particularly, a sole-mounted stabilizing element for use in athletic footwear.

2. Description of Background Art

Modern athletic footwear is a highly refined combination of elements that each perform a specific function or combination of functions directed toward promoting athletic performance. The primary elements of athletic footwear are an upper and a sole. The purpose of the upper is to comfortably enclose and secure the wearer's foot to the footwear while providing ventilation to cool the foot during athletic activities. The sole is attached to the upper and conventionally includes three layers: an outsole, a midsole, and an insole. The outsole forms the ground-contacting layer of the sole and is typically formed of a durable, wear-resistant material. The midsole forms the middle layer of the sole and is formed of a resilient foam material that attenuates impact forces that are generated when the foot contacts the ground. The insole is a thin padded member located within the upper and adjacent to the foot that improves footwear comfort.

In addition to the primary elements discussed above, athletic footwear may incorporate elements that limit pronation or enhance stability, depending upon the activities for which the footwear is designed. Running shoes, for example, commonly incorporate elements that limit the degree and rate of pronation experienced by the foot. Because rapid lateral direction changes, lunges, and jumping are not commonly associated with sprinting or distance running, running shoes often do not incorporate elements that inhibit these motions, thereby facilitating a lightweight article of footwear. In contrast, designs for footwear intended to be worn during court-style activities, including basketball, tennis, and racquetball, incorporate elements that enhance stability during rapid lateral direction changes, lunges, and jumping. Because running is also an important aspect of court-style activities, footwear designed for these sports may also include pronation control elements.

Rapid lateral direction changes, lunges, and jumping have the potential to place high levels of stress upon an athlete's foot. To reduce the probability of injury and improve stability during these motions, it is desirable for the forefoot portion of the foot to rotate with respect to the heel portion of the foot about a longitudinal axis of the foot. That is, it is desirable for the forefoot to be axially decoupled from the heel. In addition, the footwear should be sufficiently flexible in the forefoot portion to permit the digits to bend relative to the foot. Accordingly, footwear for court-style activities, or any other activity that requires a variety of motions, should provide support along the longitudinal length of the foot so as to limit non-axial, vertical flexion in the midfoot and heel area; permit the forefoot to axially flex in relation to the heel; and permit forefoot flexion.

While many sole designs support the foot, they typically do not provide adequate axial flexibility. For example, many midsoles and outsoles are monolithic structures that extend throughout the longitudinal length of the sole. The degree of stiffness in the structures directly correlates with the ability of the sole to longitudinally support a foot. In practice, a sufficiently stiff monolithic sole that fully supports a foot along its longitudinal length also significantly limits the axial flexibility of the shoe.

One known device for supporting the foot, disclosed in U.S. Pat. No. 5,832,634 to Wong, includes a stiffening plate positioned between the midsole and outsole. The stiffening plate is generally planar and constructed of a polymer and a semi-rigid material such as woven carbon fibers or glass fibers that extend longitudinally from a heel portion to a forefoot portion of the sole. The plate improves support and stability of the foot by limiting the flexibility of the sole along an axis transverse to its longitudinal length. Accordingly, the sole remains generally rigid along its length, thereby supporting the entire foot as it rolls from the heel to the toe while running or walking. While a sole having this type of stiffening plate may slightly flex axially about its longitudinal length, the limited degree of axial flexibility may also interfere with the natural pronation of the foot. See also U.S. Pat. No. 4,162,583 to Daria and U.S. Pat. No. 5,845,420 to Buccianti et al.

Soles that include stiffening elements with axial flexibility have been disclosed in, for example, U.S. Pat. No. 4,922,631 to Anderié and U.S. Pat. No. 5,319,866 to Foley et al. The Anderié patent discloses a longitudinal stiffening member positioned along the longitudinal centerline of the sole. The member extends between a front sole portion and a rear sole portion, which are separated by recesses. In the Foley patent, the weight of athletic shoes is reduced by removing a portion of the sole adjacent to a central arch region and replacing it with a lightweight arch support member spanning between an aft heel region and a forefoot region of the sole.

U.S. Pat. No. 5,896,683 to Foxen et al. discloses an article of footwear having a plurality of finger-like elements extending upward from the sole to the upper. The footwear permits flexion in the dorsi and plantar flexion plane, but not in the medial and lateral flexion plane.

Thus, despite the known prior art techniques, there remains a need for a lightweight athletic shoe that provides support along the longitudinal length of the foot so as to limit non-axial, vertical flexion in the midfoot and heel area, while promoting forefoot flexion, and permitting the forefoot to axially flex in relation to the heel.

BRIEF SUMMARY OF THE INVENTION

The present invention relates to an article of footwear having an upper and a sole structure attached to the upper. The sole structure includes a stabilizing element with a plurality of semi-rigid stabilizing members located in at least a midfoot region of the sole structure and positioned side-by-side in a medial-to-lateral direction relative to the sole structure. The stabilizing members have a combined stiffness that limits non-axial, vertical flexion of the sole structure in at least the midfoot region. At least one of said stabilizing members is independently movable with respect to a second of the stabilizing members to permit rotation of a heel region of the sole structure relative to a forefoot region of the sole structure, the rotation being about a longitudinal axis of the sole structure.

In a first embodiment, the stabilizing element includes five stabilizing members formed integral with a connecting member that is located in the heel region of the footwear. The stabilizing members protrude from the connecting member and extend through the midfoot region of the sole structure and into the forefoot region. The stabilizing members are located side-by-side in the sole structure and are evenly spaced in a medial-to-lateral direction. In the midfoot region, the stability members are approximately parallel. As the stability members extend into the wider forefoot region, they diverge so as to provide support across the width of the forefoot region, thereby remaining evenly spaced. The dimensions of the stability members are such that non-axial, vertical flexion is limited in the heel region and midfoot region and permitted in the forefoot region. In addition, the design also permits the forefoot to axially rotate in relation to the heel.

In a second embodiment, the stabilizing element includes two medial and two lateral stabilizing members that extend from an aft connecting member located in the heel region of the footwear. The medial stabilizing members join with a medial connecting member located generally under the joints that connect the third, fourth, and fifth metatarsal with their respective proximal phalanges. Similarly, the lateral stabilizing members join with a lateral connecting member located generally under the proximal hallux and the joint between the first metatarsal and proximal hallux. Like the stabilizing members of the first embodiment, the medial and lateral stabilizing members are dimensioned so as to resist non-axial, vertical bending in the midfoot and heel regions, but permit rotation of the heel region relative to the forefoot region. In addition, the medial and lateral connecting members are sufficiently flexible to facilitate bending in the forefoot region.

The various advantages and features of novelty that characterize the present invention are pointed out with particularity in the appended claims. To gain an improved understanding of the advantages and features of novelty that characterize the present invention, however, reference should be made to the descriptive matter and accompanying drawings which describe and illustrate preferred embodiments of the invention.

DETAILED DESCRIPTION OF THE INVENTION

Figure 1:
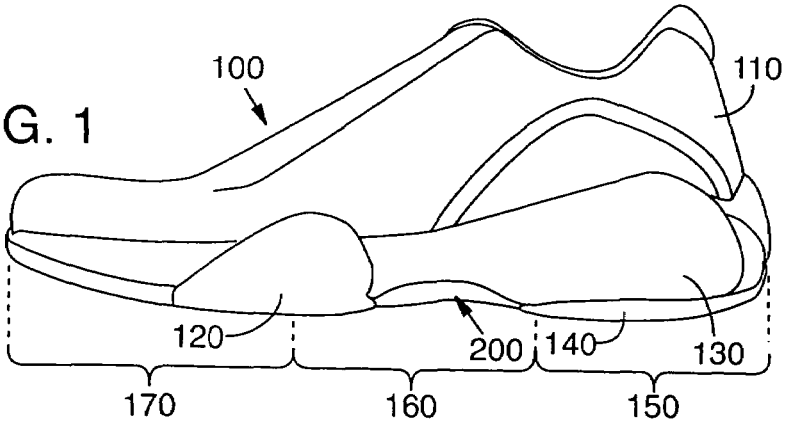
FIG. 1 is a lateral elevational view of an article of footwear in accordance with a first embodiment of the present invention.
Figure 2:
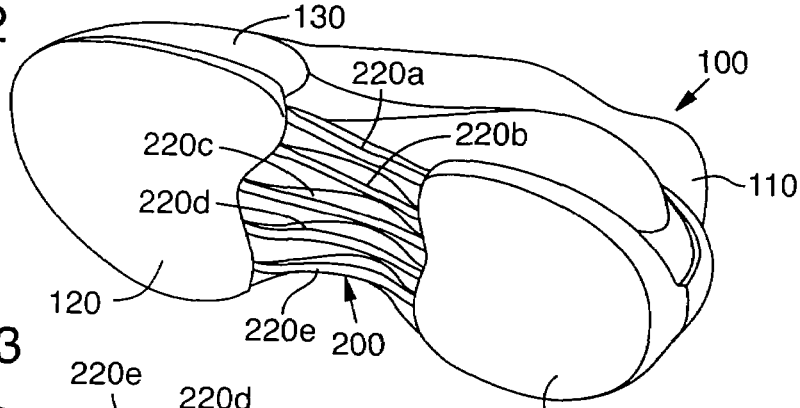
FIG. 2 is a perspective view of the lateral side, bottom, and heel portion of the article of footwear in FIG. 1.

Referring to the accompanying figures, an article of footwear in accordance with the present invention is disclosed. The figures illustrate only the article of footwear intended for use with the left foot of a wearer. A right article of footwear, such article of footwear being the mirror image of the left, is also intended to fall within the scope of the present invention. Referring to FIGS. 1 and 2, an article of footwear 100 is disclosed. Footwear 100 includes an upper 110 and a sole structure 120. Sole structure 120 includes a midsole 130, formed of a lightweight, cushioning material such as phylon, polyurethane, or ethyl vinyl acetate, and an outsole 140, formed of a durable synthetic, such as rubber, to resist wear during use. In addition, midsole 130 may include a fluid-filled bladder of the type disclosed in U.S. Pat. Nos. 4,183,156 and 4,219,945, both to Rudy. For reference purposes, sole structure 120 is divided into three general regions: a heel region 150, a midfoot region 160, and a forefoot region 170. In addition, sole structure 120 includes a longitudinal axis 180. A stabilizing element 200 extends from heel region 150, through midfoot region 160, and into forefoot region 170. In a second embodiment, stabilizing element 200 is replaced with a stabilizing element 300, as discussed below.

Figure 3:
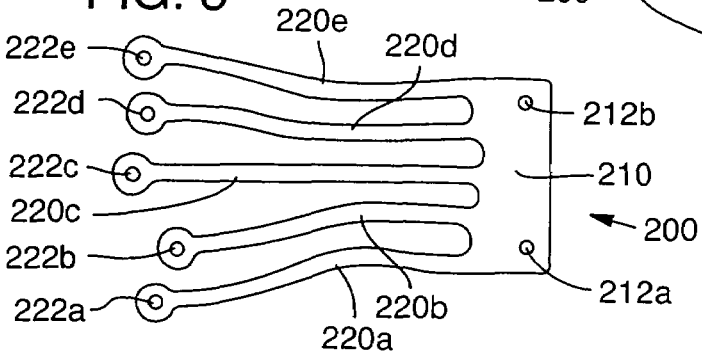
FIG. 3 is a top plan view of a stabilizing element in accordance with the first embodiment of the present invention.
Figure 4A:
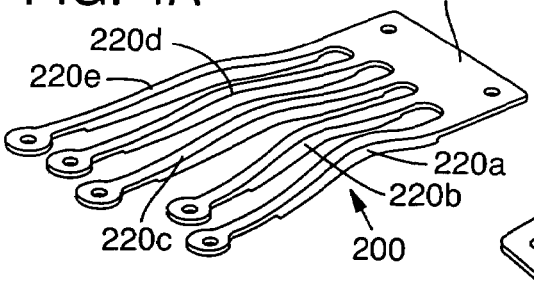
FIGS. 4A and 4B are perspective views of the stabilizing element depicted in FIG. 3.
Figure 4B:
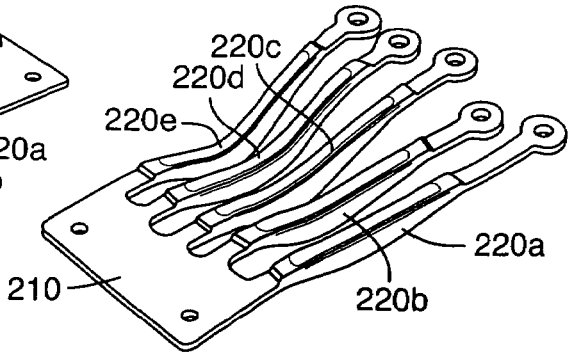
Figure 5:
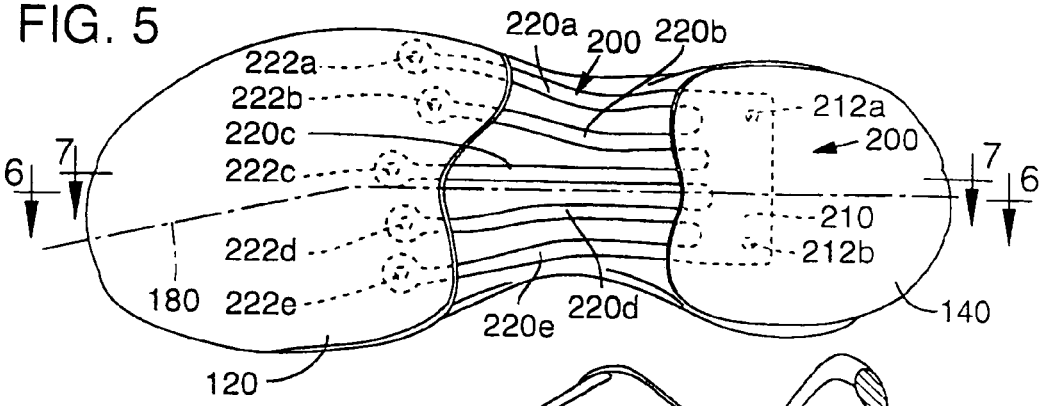
FIG. 5 is a bottom plan view of the article of footwear depicted in FIG. 1.
Figure 6:
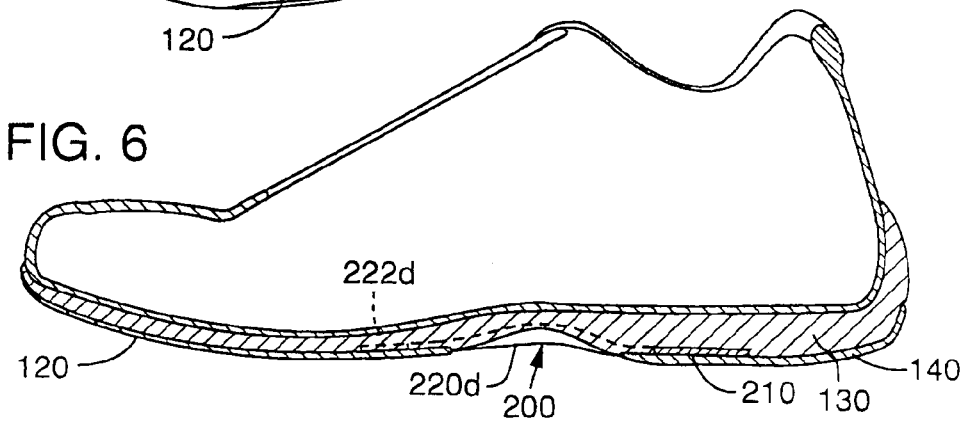
FIG. 6 is a cross-sectional view, as defined by line 6—6 in FIG. 5.
Figure 7:
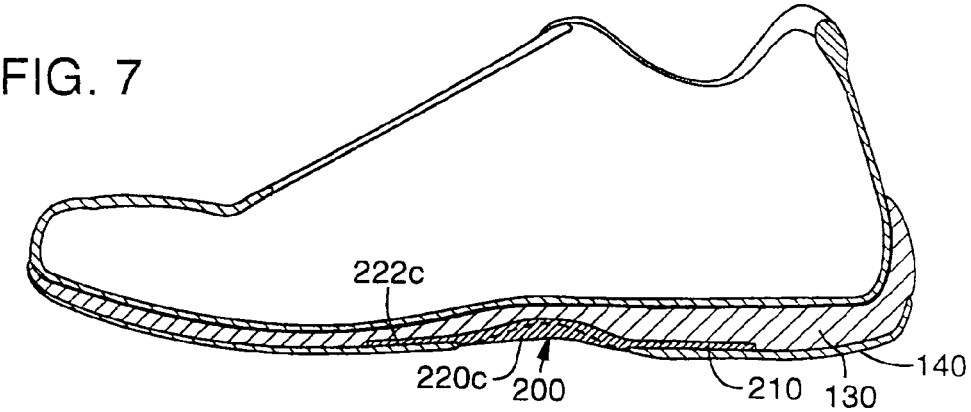
FIG. 7 is a cross-sectional view, as defined by line 7—7 in FIG. 5.

Stabilizing element 200, depicted in FIGS. 3 and 4, includes a connecting member 210 which is integrally formed with five stabilizing members 220*a–e*, which are collectively referred to hereafter as stabilizing members 220. When incorporated into footwear 100, stabilizing members 220 are substantially located in midfoot region 160 of sole structure 120 and impart both longitudinal support and axial decoupling about longitudinal axis 180. Referring to FIGS. 5–7, the position of stabilizing element 200 with respect to footwear 100 is depicted.

The dimensions and positioning of each stabilizing member 220 determines the stiffness of the support element 200, thereby affecting the degree of longitudinal support and axial decoupling in footwear 100. In general, each stabilizing member 220 may be characterized by their length and cross-sectional shape. With regard to length, stabilizing members 220 extend through at least midfoot region 160 of footwear 100, thereby having the potential to provide longitudinal support in midfoot region 160. Note that the length of each stabilizing element 220 may differ. The degree of longitudinal support is further dependent upon the cross-sectional shape of stability members 220. As depicted in the figures, stability members 220 have a generally rectangular cross-sectional shape. Other cross-sectional shapes are also intended to fall within the scope of the present invention, including round, elliptical, or triangular cross-sectional shapes, for example.

In determining the proper dimensions for stability members 220, one skilled in the art will consider many factors including, the material from which stability members 220 are formed; the number of stability members 220; the average weight of the person likely to use footwear 100 into which stability members 220 are incorporated; the areas of sole structure 120 into which stability members 220 extend; and the degree of wear that may be experienced by exposed portions of stability members 220.

The first consideration is the material from which stability members 220 are formed. Given the wide range of motions inherent in many modern athletic activities, the material chosen for stability members 220 should be durable and resistant to bending or torsional stresses. In addition, the material should retain strength at low temperatures and be lightweight. Such materials include polymers, metals, or composite materials that combine a polymer with glass, carbon, or metal fibers. Accordingly, suitable materials for stability members 220 are nylon or thermoplastic urethane with a Shore D hardness of 7.

The number of stability members 220 may vary significantly within the scope of the present invention and is important in determining the overall dimensions of each stability member 220. As the number of stability members 220 increases, the dimensions of each individual stability member 220 may be decreased to gain similar resistance to flex. As the number of stability members 220 decreases, however, the dimensions should be increased accordingly. Stabilizing element 200 may include, for example, five stability members 220 that are distributed side-by-side in a lateral-to-medial direction. In this configuration, stability members 220*a* and 220*b* are located on the lateral side of sole structure 120, thereby supporting the lateral side of the foot of the wearer. Stability member 220*c* is located in the central portion of sole structure 120 and supports the central portion of the foot. Similarly, stability members 220*d* and 220*e* are located on the medial side of sole structure 120 and support the medial side of the foot. In heel region 150 and midfoot region 160, stability members 220 are approximately parallel to each other and evenly distributed across sole structure 120. As sole structure 120 widens in the transition between midfoot region 160 and forefoot region 170, stability members 220 diverge so as to remain evenly distributed across sole structure 120. Accordingly, stability members 220*a* and 220*b* bend toward the lateral side of footwear 100, stability member 220*c* remains in the central portion of sole structure 120, and stability members 220*d* and 220*e* bend toward the medial side of footwear 100.

The third consideration is the average weight of the person likely to use footwear 100 into which stability members 220 will be incorporated. One skilled in the art of footwear design or manufacturing will have access to information correlating shoe size and weight. On average, the weight of a person will increase as shoe size increases. Accordingly, the dimensions of stabilizing members 220 may increase as shoe size increases.

Figure 8:
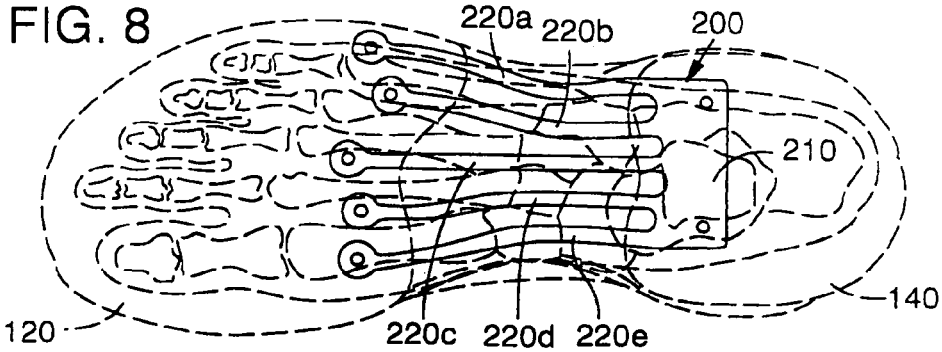
FIG. 8 is a bottom plan view that illustrates the relative placement of the stabilizing element depicted in FIG. 3, a sole structure, and bones of a foot.
Figure 9:
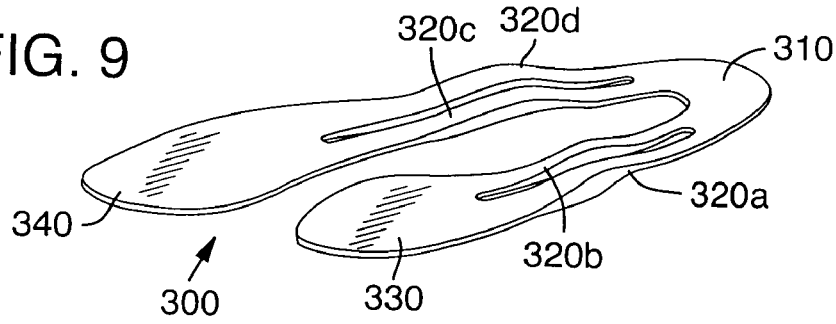
FIG. 9 is a perspective view of a stabilizing element in accordance with a second embodiment of the present invention.
Figure 10:
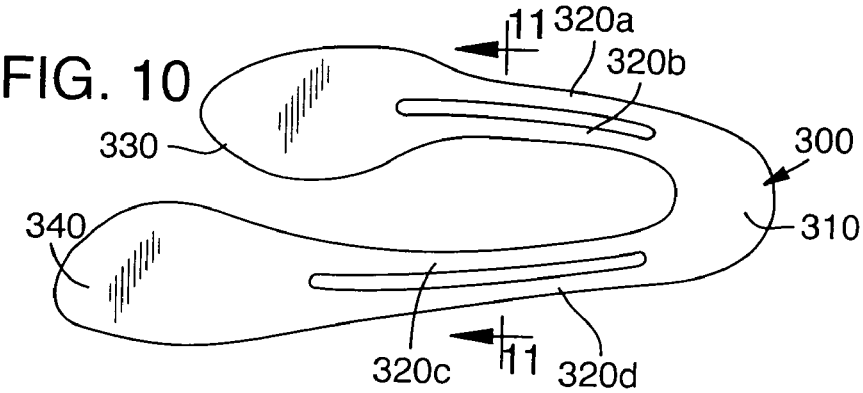
FIG. 10 is a bottom plan view of the stabilizing element depicted in FIG. 9.
Figure 11:
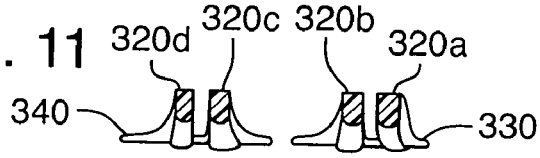
FIG. 11 is a cross-sectional view of the stabilizing element, as defined by line 11—11 in FIG. 10.

A fourth consideration relates to the areas of sole structure 120 into which stability members 220 will extend. In order to provide sufficient resistance to non-axial, vertical flexion, the length of stability members 220 should extend through at least a portion of midfoot region 160 of sole structure 120. In order to permit forefoot flexion, the extent to which stability members 220 extend under the joint connecting the proximal phalanges with the metatarsals of the wearer may be limited. If, however, stability members 220 do extend under the joint connecting the proximal phalanges with the metatarsals, see the second embodiment below, the height and width may be lessened to accommodate forefoot flexion. Accordingly, it is not necessary that stability members 220 have a uniform height and width. By varying the height and width along the length of stability members 220, the degree of flexion permitted in specific areas of footwear 100 may be controlled. Regarding the first embodiment, placement of stabilizing element 200 with respect to the bones of the foot is as illustrated in FIG. 8.

Finally, the degree of wear that may be experienced by exposed portions of stability members 220 should be considered when determining dimensions. As depicted, the upper portions of stability members 220 are embedded within midsole 130 and lower portions of stability members 220 are exposed in midfoot region 160. Depending upon the playing surface, the exposed portions of stability members 220 may experience significant wear that decreases the height of stability members 220, thereby decreasing resistance to bending. By designing an additional degree of height into stability members 220, decreases in height due to wear may be offset. A second method of countering the effects of wear is the use of a highly wear-resistant material. Similarly, use of a wear-resistant material may be coupled with locating stability members 220 above the plane of outsole 140 such that contact with the playing surface is infrequent. As depicted in FIGS. 4, 6, and 7, stabilizing members 220 are curved upwardly in the exposed region, thereby reducing the frequency that stabilizing members 220 will contact the playing surface.

As noted, the design of stabilizing element 200 is such that non-axial, vertical flexion is limited in heel region 150 and midfoot region 160 and permitted in forefoot region 170. In addition, the design also permits axial decoupling of forefoot region 170 and heel region 150. As discussed above, the primary characteristic of stabilizing element 200 that limits non-axial, vertical flexion is the stiffness in each stability member 220. Stiffness also affects the degree of axial decoupling. Accordingly, a balance should be achieved that provides sufficient longitudinal support, but permits adequate axial decoupling about longitudinal axis 180. In addition to stiffness, the degree of axial decoupling is affected by the independent nature of stability members 220. As discussed in the Description of Background Art section, prior art stability devices included stiffening plate. Although plates may provide sufficient longitudinal support, the plates do not permit the forefoot portion of the sole to rotate with respect to the heel region. This deficiency in prior art stiffening devices is overcome by forming stabilizing element 200 to have a plurality of independently movable stability members 220.

Considering the preceding factors, stability members 220, when fashioned from nylon or thermoplastic urethane, may have a height of approximately 11.2 to 11.7 millimeters and a width of approximately 5.5 to 6.2 millimeters in midfoot region 160, depending upon the size of footwear 100. These dimensions provide sufficient longitudinal support so as to limit non-axial, vertical flexion in the midfoot and heel area, while permitting forefoot flexion, but permits the forefoot to axially flex in relation to the heel. The dimensions, however, may be altered significantly as the number or the length of stability members 220 is changed, for example. In addition, the dimensions may be altered to accommodate differing styles of footwear or footwear designed for different purposes.

A final feature of each stabilizing element 200 are a plurality of apertures formed in stabilizing element 200. Apertures 212*a* and 212*b*, located in connecting member 210, and apertures 222*a*–222*e*, located on the ends of stabilizing members 220, form sites where stabilizing member is secured within a mold that forms midsole 130 around stabilizing element 200.

In a second embodiment of the present invention, a stabilizing element 300 replaces stabilizing element 200 in footwear 100. Stabilizing element 300, depicted in FIGS. 9–12, includes four stabilizing members 320 that extend from aft connecting member 310. Lateral stabilizing members 320*a* and 320*b* extend through the lateral portions of sole structure 120 and connect with lateral connecting member 330. Lateral connecting member 330 is located approximately under the joints that connect the third, fourth, and fifth metatarsal with their respective proximal phalanges. Medial stabilizing members 320*d* and 320*e* extend through the medial portions of sole structure 120 and connect with medial connecting member 340. Medial connecting member 340 is located approximately under the proximal hallux and the joint between the first metatarsal and proximal hallux. Connecting members 330 and 340 are relatively thin and flexible in comparison with stabilizing members 320*a–d*, which are collectively referred to hereafter as stabilizing members 320. Accordingly, connecting members 330 and 340 are structured with sufficient flexibility to permit forefoot flexion.

Stabilizing members 320 may be located in a single plane within sole structure 120. Alternatively, stabilizing members may have an upward bend in the midfoot or arch region that increases the distance between exposed portions and the playing surface, thereby reducing wear. The upward bend also serves to provide additional support for the arch area of the foot.

Figure 12:
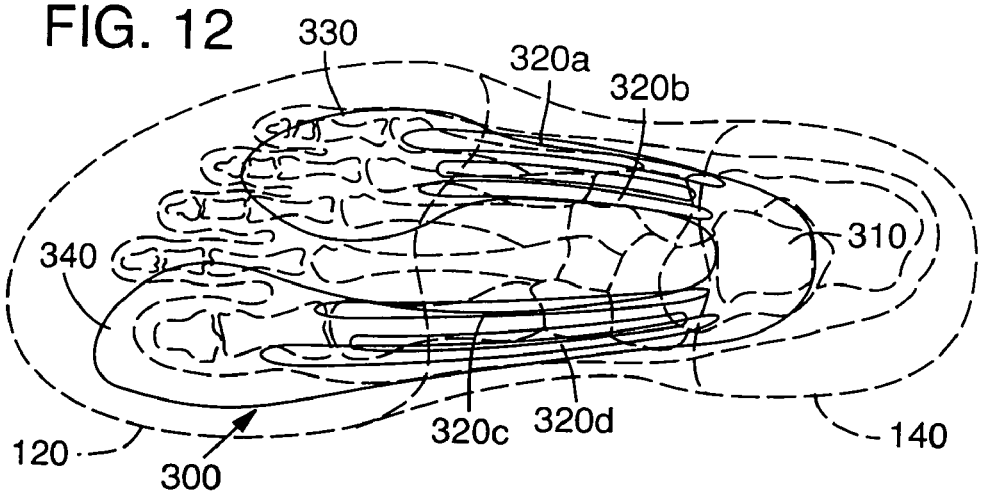
FIG. 12 is a bottom plan view that illustrates the relative placement of the stabilizing element of FIG. 9, a sole structure, and bones of the foot.

Like stabilizing element 200, stabilizing element 300 provides support along the longitudinal length of the foot so as to limit non-axial, vertical flexion in the midfoot and heel area and permit the forefoot to axially flex in relation to the heel. Placement of stabilizing element 300 with respect to the bones of the foot is illustrated in FIG. 12.

In determining the dimensions of stabilizing members 320, the considerations noted with respect to the first embodiment remain relevant. Accordingly, stability members 320 may also have a height of approximately 11.2 to 11.7 millimeters and a width of approximately 5.5 to 6.2 millimeters when fashioned from nylon or thermoplastic urethane, for example.

The present invention is disclosed above and in the accompanying drawings with reference to a variety of preferred embodiments. The purpose served by disclosure of the preferred embodiments, however, is to provide an example of the various aspects embodied in the invention, not to limit the scope of the invention. One skilled in the art will recognize that numerous variations and modifications may be made to the preferred embodiments without departing from the scope of the present invention, as defined by the appended claims.

That which is claimed is:

1. An article of footwear that includes an upper and a sole structure attached to said upper, said sole structure including a stabilizing element comprising a plurality of semi-rigid and substantially parallel stabilizing members located in at least a midfoot region of said sole structure and extending in a longitudinal direction of said sole structure, said stabilizing members having a combined stiffness that limits non-axial, vertical flexion of said sole structure in at least said midfoot region, and at least a first of said stabilizing members being independently movable with respect to a second of said stabilizing members to permit rotation of a heel region of said sole structure relative to a forefoot region of said sole structure, said rotation being about a longitudinal axis of said sole structure, said stabilizing members being positioned in said article of footwear to extend from a calcaneus bone of an individual to metatarsal bones of the individual, and said stabilizing members extending into said forefoot region, said stabilizing members having a first stiffness in said forefoot region and a second stiffness in said midfoot region, said first stiffness being less than said second stiffness, and said stabilizing members thereby being structured to permit non-axial, vertical flexion of said sole structure in an area generally underlying joints connecting proximal phalanges with metatarsals of a wearer in said forefoot region.

2. The article of footwear of claim 1, wherein at least one said stabilizing member has a generally rectangular cross-sectional shape.

3. The article of footwear of claim 2, wherein a height of said at least one said stabilizing member varies along a length of said at least one said stabilizing member.

4. The article of footwear of claim 1, wherein said stabilizing members have differential lengths.

5. The article of footwear of claim 1, wherein spaces are formed between said stabilizing members.

6. The article of footwear of claim 1, wherein lower portions of said stabilizing members are exposed in said midfoot region of said sole.

7. The article of footwear of claim 6, wherein upper portions of said stabilizing members are embedded within said midfoot region of said sole.

8. The article of footwear of claim 1, wherein fore portions and aft portions of said stabilizing members are embedded within a midsole, said midsole being attached to an outsole in said forefoot region and said heel region.

9. The article of footwear of claim 1, wherein a material that forms said stabilizing element is a polymer.

10. The article of footwear of claim 1, wherein a portion of each said stabilizing member has an upwardly-curved shape in said midfoot region of said sole.

11. The article of footwear of claim 1, wherein said plurality of stabilizing members include at least two medial stabilizing members and at least two lateral stabilizing members, said medial stabilizing members being located on a medial side of said footwear and said lateral stabilizing members being located on a lateral side of said footwear.

12. The article of footwear of claim 11, wherein said plurality of stabilizing members further includes a central stabilizing member, said central stabilizing member being located between said medial and lateral stabilizing members.

13. The article of footwear of claim 11, wherein said stabilizing members are connected to a connecting member in said heel region.

14. The article of footwear of claim 13, wherein said stabilizing members have separate distal ends in said forefoot region.

15. An article of footwear that includes an upper and a sole structure attached to said upper, said sole structure including a stabilizing element comprising:

at least three semi-rigid stabilizing members located in at least a midfoot region of said sole structure and positioned side-by-side in a medial-to-lateral direction relative to said sole structure, each said stabilizing member having an upwardly-curved shape in a midfoot region of said sole, each of said stabilizing members having a vertical thickness and a horizontal width that are defined at a central portion of said each of said stabilizing members, said vertical thickness being greater than said horizontal width at said central portion, and said stabilizing members having a combined stiffness that limits non-axial, vertical flexion of said sole structure in at least said midfoot region, and at least a first of said stabilizing members being independently movable with respect to a second of said stabilizing members to permit rotation of a heel region of said sole structure relative to a forefoot region of said sole structure, said rotation being about a longitudinal axis of said sole structure; and a connecting member that extends between said stabilizing members and connects said stabilizing members to each other.

16. The article of footwear of claim 15, wherein said vertical thickness of each said stabilizing member varies along a length of said each said stabilizing member.

17. The article of footwear of claim 15, wherein a length of said first stabilizing member differs from a length of said second stabilizing member.

18. The article of footwear of claim 15, wherein spaces are formed between said stabilizing members.

19. The article of footwear of claim 15, wherein said stabilizing members extend only into aft portions of said forefoot region, thereby permitting non-axial, vertical flexion of said sole structure in an area generally underlying joints connecting proximal phalanges with metatarsals of a wearer in said forefoot region of said sole.

20. The article of footwear of claim 15, wherein said stabilizing members extend into said forefoot region of said footwear, said stabilizing members having a first stiffness in said forefoot region and a second stiffness in said midfoot region, said first stiffness being less than said second stiffness, and said stabilizing members thereby being structured to permit non-axial, vertical flexion of said sole structure in an area generally underlying joints connecting proximal phalanges with metatarsals of a wearer in said forefoot region of said sole.

21. The article of footwear of claim 15, wherein fore portions and aft portions of said stabilizing members are embedded within a midsole, said midsole being attached to an outsole in said forefoot region and said heel region.

22. The article of footwear of claim 15, wherein a material that forms said stabilizing element is a polymer.

23. The article of footwear of claim 15, wherein said footwear includes five said stabilizing members.

24. The article of footwear of claim 15, wherein said connecting member is located in said heel region.

25. The article of footwear of claim 24, wherein said stabilizing members have separate distal ends in said forefoot region.

26. An article of footwear that includes an upper and a sole structure attached to said upper, said sole structure including a stabilizing element comprising a plurality of semi-rigid stabilizing members located in at least a midfoot region of said sole structure and positioned side-by-side in a medial-to-lateral direction relative to said sole structure, at least a first of said stabilizing members being independently movable with respect to a second of said stabilizing members, and each of said first and said second of said stabilizing members having a vertical thickness and a horizontal width that are defined at a central portion of said each of said first and said second of said stabilizing members, said vertical thickness being greater than said horizontal width at said central portion.

27. The article of footwear of claim 26, wherein at least one said stabilizing member has a generally rectangular cross-sectional shape.

28. The article of footwear of claim 27, wherein said vertical thickness of said each of said first and said second of said stabilizing members varies along a length of said each of said first and said second of said stabilizing members.

29. The article of footwear of claim 26, wherein spaces are formed between said stabilizing members.

30. The article of footwear of claim 26, wherein lower portions of said stabilizing members are exposed in said midfoot region of said sole.

31. The article of footwear of claim 30, wherein upper portions of said stabilizing members are embedded within said midfoot region of said sole.

32. The article of footwear of claim 26, wherein a portion of each said stabilizing member has an upwardly-curved shape in said midfoot region of said sole.

33. An article of footwear that includes an upper and a sole structure attached to said upper, said sole structure including a stabilizing element comprising a plurality of semi-rigid and substantially parallel stabilizing members located in at least a midfoot region of said sole structure and extending in a longitudinal direction of said sole structure, at least a first of said stabilizing members being independently movable with respect to a second of said stabilizing members, and said stabilizing members being positioned in said article of footwear to extend from a calcaneus bone of an individual to metatarsal bones of the individual.

34. The article of footwear of claim 33, wherein at least one said stabilizing member has a generally rectangular cross-sectional shape.

35. The article of footwear of claim 34, wherein a height of said at least one said stabilizing member varies along a length of said at least one said stabilizing member.

36. The article of footwear of claim 33, wherein said stabilizing members have differential lengths.

37. The article of footwear of claim 33, wherein spaces are formed between said stabilizing members.

38. The article of footwear of claim 33, wherein lower portions of said stabilizing members are exposed in said midfoot region of said sole.

39. The article of footwear of claim 38, wherein upper portions of said stabilizing members are embedded within said midfoot region of said sole.

40. The article of footwear of claim 33, wherein a portion of each said stabilizing member has an upwardly-curved shape in said midfoot region of said sole.

41. The article of footwear of claim 33, wherein first ends of said stabilizing members are connected to a connecting member.

42. The article of footwear of claim 41, wherein said stabilizing members have separate distal second ends, said first ends being opposite said second ends.

43. An article of footwear that includes an upper and a sole structure attached to said upper, said sole structure including a stabilizing element comprising a plurality of semi-rigid and substantially parallel stabilizing members located in at least a midfoot region of said sole structure and extending in a longitudinal direction of said sole structure, said stabilizing members having a combined stiffness that limits non-axial, vertical flexion of said sole structure in at least said midfoot region, and at least a first of said stabilizing members being independently movable with respect to a second of said stabilizing members to permit rotation of a heel region of said sole structure relative to a forefoot region of said sole structure, said rotation being about a longitudinal axis of said sole structure, said stabilizing members being positioned in said article of footwear to extend from a calcaneus bone of an individual to metatarsal bones of the individual, and said plurality of stabilizing members include at least two medial stabilizing members and at least two lateral stabilizing members, said medial stabilizing members being located on a medial side of said footwear and said lateral stabilizing members being located on a lateral side of said footwear, said medial stabilizing members being connected to a medial connecting member on a medial side of said forefoot region, and said lateral stabilizing members being connected to a lateral connecting member on a lateral side of said forefoot region, said stabilizing members and said connecting members forming a generally u-shaped stabilizing element.

44. The article of footwear of claim 33, wherein each said stabilizing member has an upwardly-curved shape in said midfoot region of said sole.

* * * * *